United States Patent [19]

Schwaller

[11] Patent Number: 4,484,403

[45] Date of Patent: Nov. 27, 1984

[54] WEAPON MAGAZINE

[75] Inventor: Bruno Schwaller, Rohr, Switzerland

[73] Assignee: SIG Schweizerische Industrie-Gesellschaft, Neuhausen am Rheinfall, Switzerland

[21] Appl. No.: 455,849

[22] Filed: Jan. 5, 1983

[30] Foreign Application Priority Data

Jan. 5, 1982 [CH] Switzerland ..... 36/82

[51] Int. Cl.[3] ..... F41C 25/02

[52] U.S. Cl. ..... 42/50

[58] Field of Search ..... 42/50, 18, 22

[56] References Cited

U.S. PATENT DOCUMENTS

| | | | |
|---|---|---|---|
| 2,289,067 | 7/1942 | Owsley | 42/50 |
| 3,191,332 | 6/1965 | Ardolino | 42/50 |
| 3,623,256 | 11/1971 | Shiplee | 42/50 |
| 4,127,954 | 12/1978 | Hausmann | 42/50 |
| 4,133,445 | 1/1979 | Mandelbaum . | |

FOREIGN PATENT DOCUMENTS

| | | | |
|---|---|---|---|
| 96284 | 2/1898 | Fed. Rep. of Germany . | |
| 1094156 | 12/1960 | Fed. Rep. of Germany | 42/50 |
| 1483260 | 6/1967 | France . | |
| 2192284 | 2/1974 | France . | |
| 481361 | 12/1969 | Switzerland . | |
| 500642 | 1/1971 | Switzerland . | |

OTHER PUBLICATIONS

D. H. R. Archer, "Jane's Infantry Weapons", 1976, pp. 255-256, Jane's Yearbooks, London, GB. 5.56 mm M16A1 Automatic Rifle, Squad Automatic Weapon.

*Primary Examiner*—Charles T. Jordan
*Attorney, Agent, or Firm*—Spencer & Frank

[57] ABSTRACT

A weapon magazine including a housing having opposite, parallel-extending side walls each having an outer face. There is provided a manually releasable coupling arrangement on the outer face of the side walls of the magazine housing for joining together a first weapon magazine and a second weapon magazine in an identical orientation wherein one side wall of the first weapon magazine faces one side wall of the second weapon magazine. There are further provided spacers on the outer face of the side walls to maintain the first and second magazines at a predetermined distance from one another in a joined state thereof.

12 Claims, 4 Drawing Figures

WEAPON MAGAZINE

BACKGROUND OF THE INVENTION

This invention relates to a weapon magazine including a magazine housing formed of two parallel side walls, front and rear walls, as well as a bottom plate and further has a feeder plate advanced by a follower spring supported on the base plate inside the housing.

Weapon magazines of the above-outlined type are known and are disclosed, for example, in Swiss patent Nos. 481,361 and 500,462. In view of the fact that particularly combat ammunition of high muzzle velocity has cartridge casings whose diameter is, at the base of the casing, greater than at its end which surrounds the bullet, difficulties have been encountered in designing the magazine for accommodating an increased amount of cartridges.

Because of the non-uniform diameter of the cartridges the magazine housing is arcuate so that in the magazine the bullet tips are, at least approximately, oriented towards a common point. An increase of the quantity of cartridges in the magazine could be effected by stacking the cartridges in two rows so that present-day magazines are generally of a capacity of thirty cartridges.

Since automatic precision weapons are used with increasing frequency instead of earlier rapid-fire machine guns, the above-discussed disadvantange of limited cartridge capacity per magazine has become increasingly pronounced. In order to increase the cartridge capacity it is known to secure together two magazines by means of a wire or adhesive strip. For exchanging the emptied magazine with a charged one, the marksman, after removing the empty magazine had to turn the two interconnected magazines around for correctly orienting the charged magazine for insertion into the weapon. A 180° rotation of the two magazines has been disadvantageous since such an operation had to be carried out with a single hand, whereby risks of dropping and thus soiling the magazines were very high.

SUMMARY OF THE INVENTION

It is an object of the invention to provide an improved magazine which can be coupled in a simple manner with a second magazine and which, upon magazine replacement, can be manipulated with a single hand without difficulty.

This object and others to become apparent as the specification progresses, are accomplished by the invention, according to which, briefly stated, the side walls of the magazine are provided with mounting means for releasably coupling together two magazines in identical orientation and with spacers to maintain a distance between the two magazine housings.

DESCRIPTION OF THE PREFERRED EMBODIMENT

Figure 1:
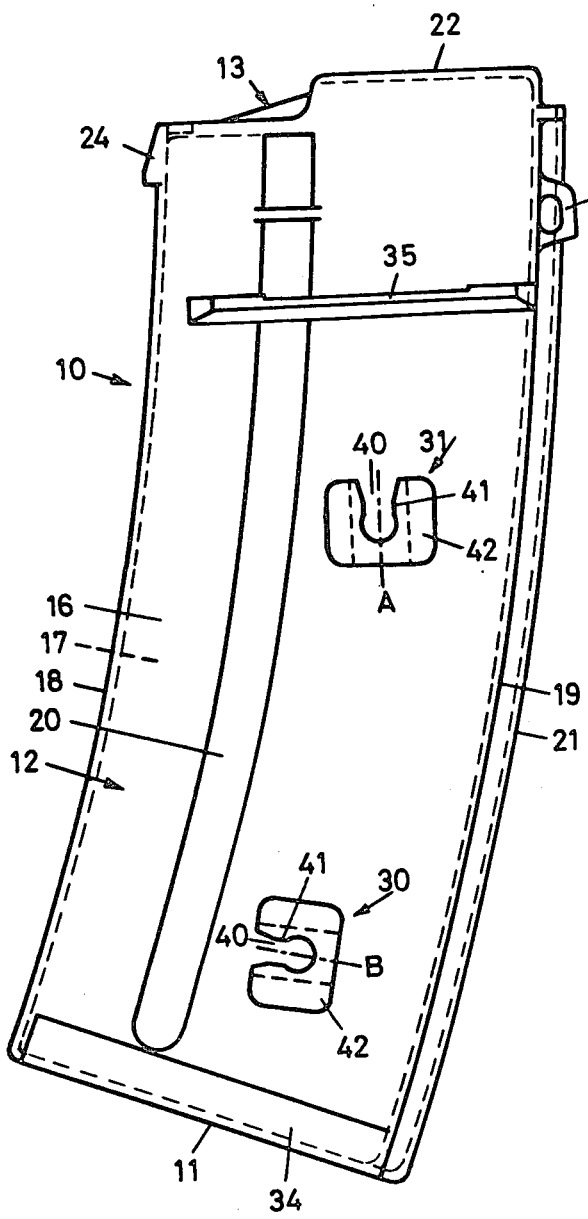
FIG. 1 is a side elevational view of a magazine according to a preferred embodiment of the invention.
Figure 2:
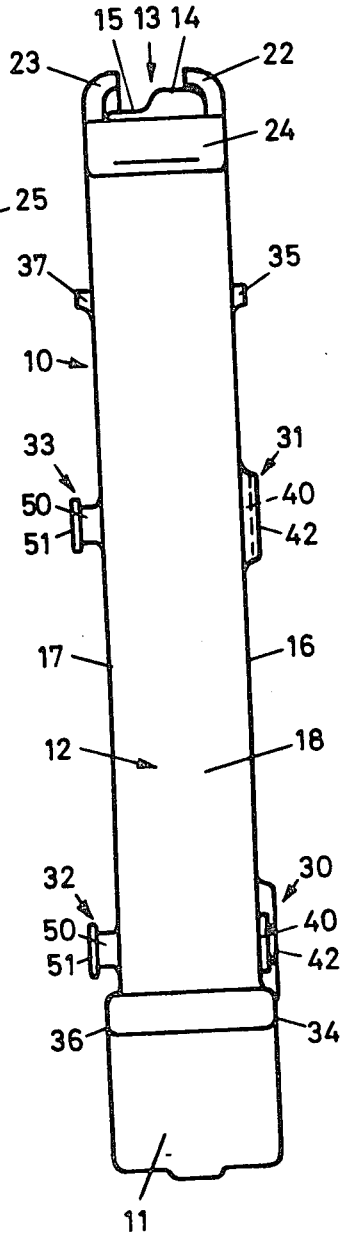
FIG. 2 is a front elevational view of the preferred embodiment.

The magazine which incorporates the invention is, for performing its basic function of storing and feeding cartridges, structured conventionally for automatic weapons, particularly hand-held weapons. Thus, as shown in FIG. 1, the magazine 10 which has a capacity of approximately thirty cartridges, has a base plate 11 closing off a magazine housing 12 at the bottom. A follower spring (not shown) is supported within the magazine housing 12 on the base plate 11 and carries a feeder plate 13, urging it upwardly. As seen in FIG. 2, the feeder plate 13 has an elevated portion 14 and a lower-lying part 15 so that two cartridges which are slightly staggered heightwise, may lie side by side to thus prevent malfunction during the loading of cartridges from the magazine into the weapon chamber. Such a malfunction is likely to occur in case two cartridges simultaneously present their bases to the weapon bolt.

The magazine housing 12 has two side walls 16 and 17, a front wall 18 and a rear wall 19. The two side walls 16 and 17 are each provided with a longitudinally extending, inwardly projecting rib 20 for laterally guiding the cartridge column and the feeder plate 13. The rear wall 19 is provided with an outwardly projecting rib 21 which serves as a third guide for the feeder plate 13. The side walls 16 and 17 each have an upper, inwardly bent edge portion 22 and 23, respectively, while the front wall 8 has at its upper portion a snap-in shoulder 24 and the rear wall 19 has an abutment lug 25. These components serve for the introduction of the magazine 10 into the magazine opening of the weapon.

The front wall 18 and the rear wall 19 extend arcuately, whereby the magazine has a curved configuration: the front wall 18 is outwarldy concave between the base plate 11 and the snap-in shoulder 24, while the rear wall 19 is outwardly convex between the base plate 11 and the abutment lug 25. By virtue of this arrangement, thirty forwardly tapering conventional cartridges can be accommodated by the magazine.

According to the invention, securing means 30, 31, 32 and 33 are mounted on the magazine 10 for releasably coupling two magazine housings together and there are further provided spacers 34, 35, 36 and 37 to maintain the interconnected magazine housings in a predetermined distance from one another.

The securing means comprise two spaced female coupling parts 30 and 31 mounted on the side wall 16 and two spaced male coupling parts 32 and 33 mounted on the other side wall 17. Each female coupling part 30 and 31 has a spaced socket 42 which is arranged with a clearance from the side wall 16 and which has a slotted opening 40. Each male coupling part 32, 33 is a mushroom-shaped pin each having a stem part 50 and a head part 51. The slot 40 has a keyhole-like configuration whereby a narrowed part 41 is formed. In this manner, a certain force has to be exerted to cause the coupling parts to engage into one another. The diameters of the stem 50 and the head part 51 are so designed that the stem 50 may be pushed into the slot 40, while the head part 51 extends below the underside of the socket 42, facing the side wall 16.

The sockets 42 are formed as strips bent in a U shape wherein the free ends of the legs of the U are bonded to the side wall 16 and are interconnected by a web part in which the slot 40 is formed. Should the inside of the socket be soiled, the dirt is automatically ejected by the male coupling members as two magazines are coupled to one another. The slot 40 of the female coupling members 31 and 30 has a respective central axis A and B which extends parallel to the edges where the web of the U joins the legs thereof.

Figure 3:
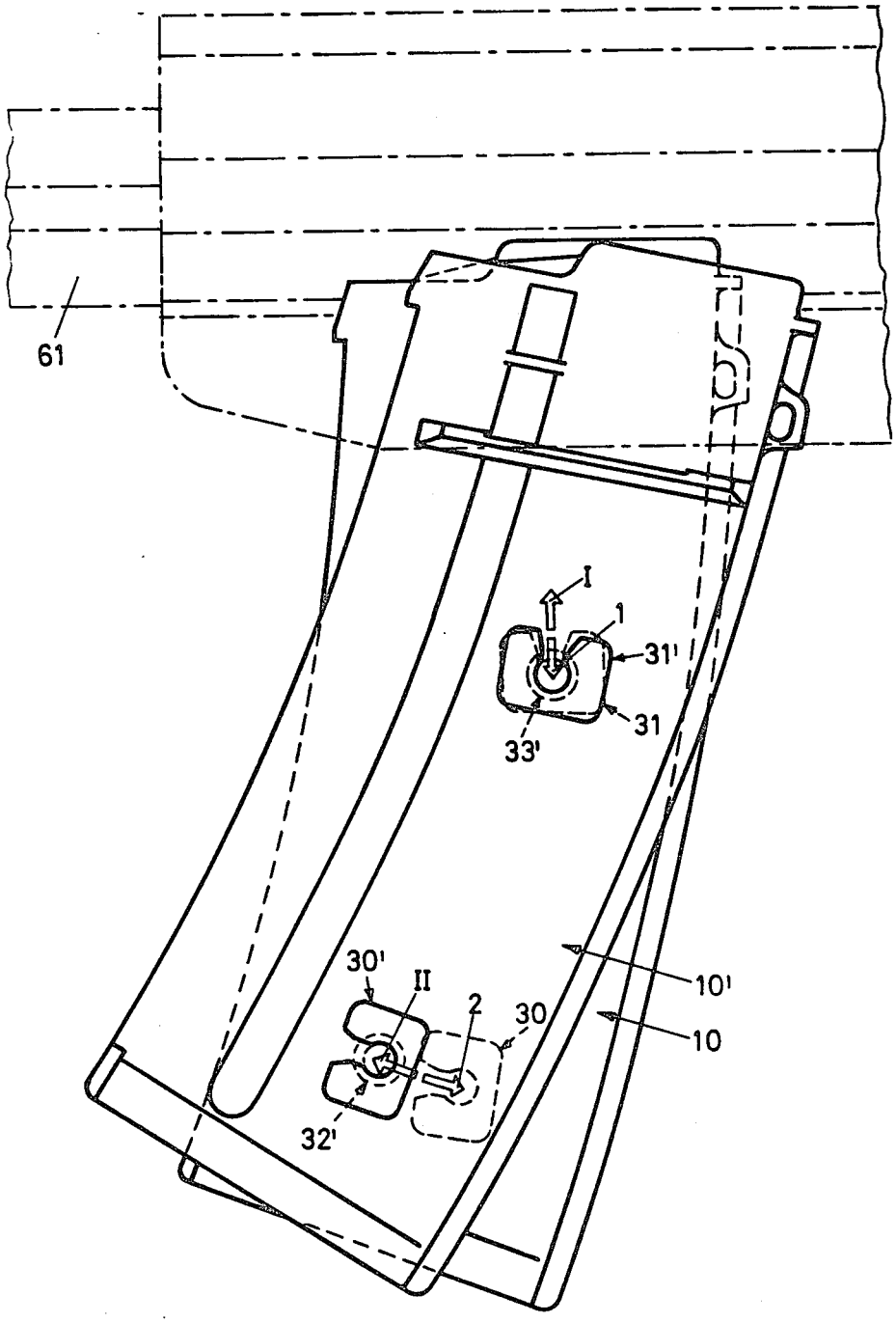
FIG. 3 is a side elevational view showing two magazines to illustrate coupling and releasing thereof.

The central axes A, B of the slots 40 of the respective socket 42 of the female coupling members 31 and 30 are arranged at an angle of 80°–100° with respect to one another. This arrangement means that for the coupling and releasing of two magazines two motions have to take place. The motions of the two magazines 10 and 10' are shown in FIG. 3 with arrows 1, 2 for performing the coupling operation and with arrows I and II for performing the disconnection (release) thereof. Thus, for performing the coupling operation, first the two upper coupling parts 31, 33' of the respective magazines 10 and 10' are to be joined to one another by means of a longitudinal displacement of the magazines with respect to one another and thereafter the two lower coupling parts 30 and 32' are joined together by means of a relative rotary motion of the magazines 10, 10' about the upper coupling parts 31 and 33'.

For separating (releasing) the two magazines from one another, the magazine 10' (which is closer to the viewer in FIG. 3) is first rotated with respect to the magazine 10 in the direction of the arrow II and then shifted parallel to the arrow I relative to the magazine 10.

Figure 4:
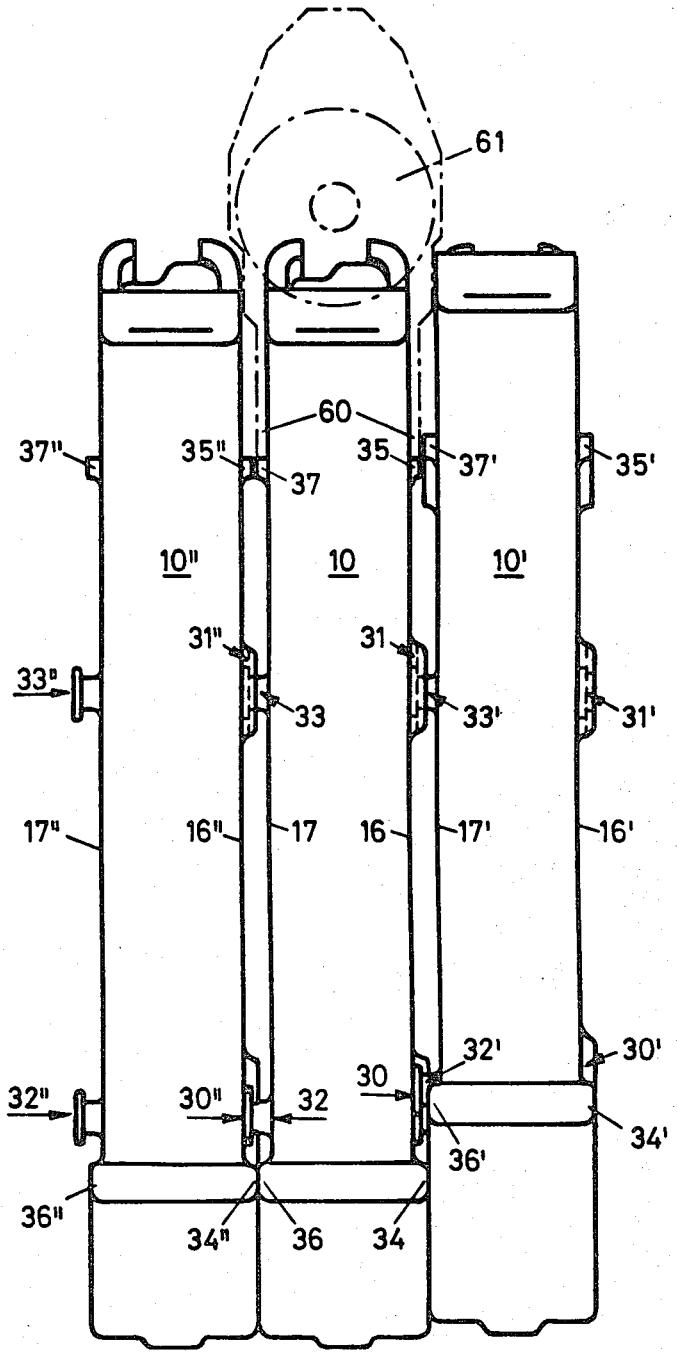
FIG. 4 is a front elevational view of three interconnected magazines according to the preferred embodiment of the invention wherein the central magazine is shown inserted in the weapon and one of the flanking magazines is in a partially released state.

Reverting once again to FIGS. 1 and 2, and also referring to FIG. 4, each magazine is provided with ribs 34, 35, 36 and 37 which extend transversely on the side walls 16 and 17 and which constitute spacers. The ribs 34–37 extend at least approximately in a radial direction with respect to the curvature of the front and rear walls 18 and 19. The ribs 35 and 37 are of identical configuration and are aligned in a single plane perpendicular to the side walls 16, 17. Similarly, the ribs 34 and 36 are of identical configuration and are aligned in a single plane perpendicular to the side walls 16, 17. The female coupling members 30 and 31 are situated between the ribs 34 and 35, while the male coupling members 32 and 33 are situated between the ribs 36 and 37. The height of the cooperating ribs (for example, the ribs 35'', 37 and 35, 37') of the two coupled magazine housings together should be such that the wall 60 of the bolt housing of the weapon 61, shown in phantom lines in FIG. 4, can project into the clearance between the two adjoining magazine housings. In order to ensure that a cooperation between the coupling parts and the spacers occurs without friction, the ribs 35-37 should be of lesser height than the pins 32, 33 but they should be more elevated than the socket structures of the female coupling members 30 and 31.

As illustrated in FIG. 4, either of the two magazines 10' or 10'' which flank the magazine 10 inserted into the weapon may be removed from or attached to the central magazine 10. This is illustrated by showing the magazine 10' in a half-attached position, in the same angular orientation with respect to the magazine 10 as shown in the side elevational illustration of FIG. 3.

The magazine 10 is preferably made of a synthetic material such as a polymer or an elastomer which has a certain elasticity whereby the coupling members (where elasticity is desired) may be made as one-piece components with the magazine walls.

It will be understood that the above description of the present invention is susceptible to various modifications, changes and adaptations, and the same are intended to be comprehended within the meaning and range of equivalents of the appended claims.

I claim:

1. A weapon magazine including a housing having opposite, parallel-extending first and second side walls each having an outer face; comprising (a) manually releasable coupling means on the outer face of said side walls for joining together a first said weapon magazine and a second said weapon magazine in an identical orientation wherein one said side wall of the first weapon magazine faces one said side wall of the second weapon magazine; said coupling means including two spaced male coupling members affixed to said first side wall and two spaced female coupling members affixed to said second side wall; each said male coupling member of said first weapon magazine cooperating with respective said female coupling members of said second weapon magazine; and (b) spacer means on the outer face of said side walls to maintain said first and second magazines at a predetermined distance from one another in a joined state thereof.

2. A weapon magazine as defined in claim 1, wherein each said female coupling member comprises a socket affixed to said second side wall; said socket having a socket portion extending spaced from said second side wall and having opposite edges spaced from said second side wall; means defining a slot in said socket portion; said slot being open solely at one of said edges; further wherein each said male coupling member comprises a mushroom-shaped pin having a stem affixed to said first side wall and projecting therefrom and a head part at an end of said stem; said head part having a diameter greater than a diameter of said stem and being wider than a width dimension of said slot, whereby said mushroom-shaped pin is receivable in said socket.

3. A weapon magazine as defined in claim 2, wherein said slot is keyhole shaped and includes a narrowed part for forming a snap-in connection with the stem of a cooperating said male coupling member.

4. A weapon magazine as defined in claim 2, wherein each socket comprises a U-shaped strip member having leg portions affixed to said second side wall and a web joining said leg portions; said web constituting said socket portion; further wherein said slot has a longitudinal axis extending parallel to edges formed by said web with each said leg portion.

5. A weapon magazine as defined in claim 4, wherein the longitudinal axis of the slot of the one female coupling member forms an angle of 80°–100° with the longitudinal axis of the slot of the other female coupling member.

6. A weapon magazine as defined in claim 1, wherein said spacer means on one side wall of said first weapon magazine is arranged for assuming an abutting relationship with said spacer means on one side wall of said second weapon magazine in said joined state thereof.

7. A weapon magazine including a housing having a curved length and opposite, parallel-extending first and second side walls each having an outer face; comprising (a) manually releasable coupling means on the outer face of said side walls for joining together a first said weapon magazine and a second said weapon magazine in an identical orientation wherein one said side wall of the first weapon magazine faces one said side wall of the second weapon magazine; and (b) spacer means on the outer face of said side walls to maintain said first and second magazines at a predetermined distance from one another in a joined state thereof; said spacer means on one side wall of said first weapon magazine being arranged for assuming an abutting relationship with said spacer means on one side wall of said second weapon magazine in said joined state thereof; said spacer means comprising ribs on said first and second side walls; said ribs extending radially with respect to the curvature of said curved length.

8. A weapon magazine as defined in claim 7, wherein said coupling means comprises a male coupling member affixed to said first side wall and a female coupling member affixed to said second side wall; said male coupling member of said first weapon magazine cooperating with said female coupling member of said second weapon magazine in said joined state.

9. A weapon magazine as defined in claim 8, wherein said female coupling member comprises a socket affixed to said second side wall; said socket having a socket portion extending spaced from said second side wall and having opposite edges spaced from said second side wall; means defining a slot in said socket portion; said slot being open solely at one of said edges; further wherein said male coupling member comprises a mushroom-shaped pin having a stem affixed to said first side wall and projecting therefrom and a head part at an end of said stem; said head part having a diameter greater than a diameter of said stem and being wider than a width dimension of said slot, whereby said mushroom-shaped pin is receivable in said socket; further wherein each rib has a height that is greater than the distance of said socket portion from said second side wall and smaller than a height of said mushroom-shaped pin measured from said first side wall.

10. A weapon magazine as defined in claim 9, wherein from each said side wall there project two said ribs spaced in a direction parallel to a length of said magazine; said coupling means being situated on each said side wall between the respective two ribs.

11. A weapon magazine as defined in claim 8, wherein said female coupling member comprises a socket affixed to said second side wall; said socket having a socket portion extending spaced from said second side wall and having opposite edges spaced from said second side wall; means defining a slot in said socket portion; said slot being open solely at one of said edges; further wherein said male coupling member comprises a mushroom-shaped pin having a stem affixed to said first side wall and projecting therefrom and a head part at an end of said stem; said head part having a diameter greater than a diameter of said stem and being wider than a width dimension of said slot, whereby said mushroom-shaped pin is receivable in said socket.

12. A weapon magazine as defined in claim 7, wherein said ribs on said first side wall are aligned with said ribs on said second side wall in respective planes perpendicular to said first and second side wall; and further wherein the ribs being in alignment with one another have identical configurations.

* * * * *